United States Patent [19]

Tassie

[11] 4,023,463

[45] May 17, 1977

[54] LIQUID PROPELLANT GUN (CHECK VALVE AND DAMPER)

[75] Inventor: Douglas Pray Tassie, Williston, Vt.

[73] Assignee: General Electric Company, Burlington, Vt.

[22] Filed: June 10, 1976

[21] Appl. No.: 694,867

[52] U.S. Cl. ..... 89/7; 417/349; 417/381

[51] Int. Cl.[2] ..... F41F 1/04

[58] Field of Search ..... 89/7, 9, 1 K; 417/349, 417/377, 381; 60/39.01

[56] References Cited

UNITED STATES PATENTS

| | | | |
|---|---|---|---|
| 2,605,708 | 8/1952 | Smedes | 417/377 X |
| 2,884,000 | 4/1959 | Witter | 417/377 X |
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |
| 3,690,255 | 9/1972 | Vass et al. | 89/7 X |
| 3,763,739 | 10/1973 | Tassie | 89/7 |

*Primary Examiner*—David H. Brown
*Attorney, Agent, or Firm*—Bailin L. Kuch

[57] ABSTRACT

A liquid propellant gun utilizes a differential piston having a plurality of bores through its head, which head divides the liquid propellant pumping chamber from the combustion chamber, and propellant supply means providing liquid propellant under pressure into said pumping chamber, which propellant under pressure both advances the piston to enlarge the pumping chamber and to decrease the combustion chamber and injects and atomizes a predetermined quantity of propellant through said bores from said pumping chamber into said combustion chamber, and a check valve which precludes flow of liquid propellant under pressure from said piston to said propellant supply means and damps said piston at the end of its combustion stroke by means of a damping cylinder.

11 Claims, 5 Drawing Figures

V
V
10
12
14
16
18
20
22
24
26
27
28
30
32
34
36
68
70
102
104
116
118
120
124
126
128
130
132
134
136

LIQUID PROPELLANT GUN (CHECK VALVE AND DAMPER)

BACKGROUND OF THE INVENTION

1. Field of the Invention

This invention relates to liquid propellant guns utilizing a differential piston to provide continued or regenerative injection of propellant into the combustion chambers afte initial ignition of propellant in the chamber.

2. Prior Art

Liquid propellant guns utilizing differential pistons to pump propellant into the combustion chamber during combustion are now well known. Early work is described in a Final Report of Nov. 19, 1953—Jan. 31, 1956 under contract DA-36-034-ORD-1504RD, Project TS1-47-8 by V. M. Barnes, Jr. et al which apparently in part corresponds to Jukes et al, U.S. Pat. No. 3,138,990 filed Oct. 9, 1961; in a report No. 17-2 of June 15, 1954 under contract NOrd-10448 by C. R. Foster et al; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al U.S. Pat. No. 2,981,153, filed Nov. 14, 1952; C. M. Hudson, U.S. Pat. No. 2,986,072, filed Nov. 19, 1952; and E. J. Vass, et al, U.S. Pat. No. 3,690,255 filed Oct. 1, 1970. Certain of these patents, e. g. Jukes et al, show the use of valves to control the entrance of propellant into the combustion chamber.

An object of this invention is to provide an improved check valve for a liquid propellant gun having a combustor assembly utilizing a different piston which will preclude ullage at the supply face of said piston and which will provide damping of said piston at the end of its combustion stroke.

A feature of this invention is the provision of a liquid propellant gun utilizing a differential piston having a plurality of bores through its head, which head divides the liquid propellant pumping chamber from the combustion chamber, and propellant supply means providing liquid propellant under pressure into said pumping chamber, which propellant under pressure both advances the piston to enlarge the pumping chamber and to decrease the combustion and injects abd atomizes a predetermined quantity of propellant through said bores from said pumping chamber into said combustion chamber, and a check valve which precludes flow of liquid propellant under pressure from said piston to said propellant supply means and damps said piston at the end of its combustion stroke.

RELATED CASES

Subject matter directed to the different piston disclosed herein is claimed in the application of A. R. Graham, filed concurrently herewith, Ser. No. 694,866. Subject matter directed to scaling using a plurality of combustor assemblies disclosed herein is claimed in the application of A. R. Graham, filed concurrently herewith Ser. No. 694,869.

BRIEF DESCRIPTION OF THE DRAWING

These and other objects, advantages and features of the invention will be apparent from the following specification thereof taken in conjunction with the accompanying drawing in which.

DESCRIPTION OF THE PREFERRED EMBODIMENT

Figures 1, 3, 5:
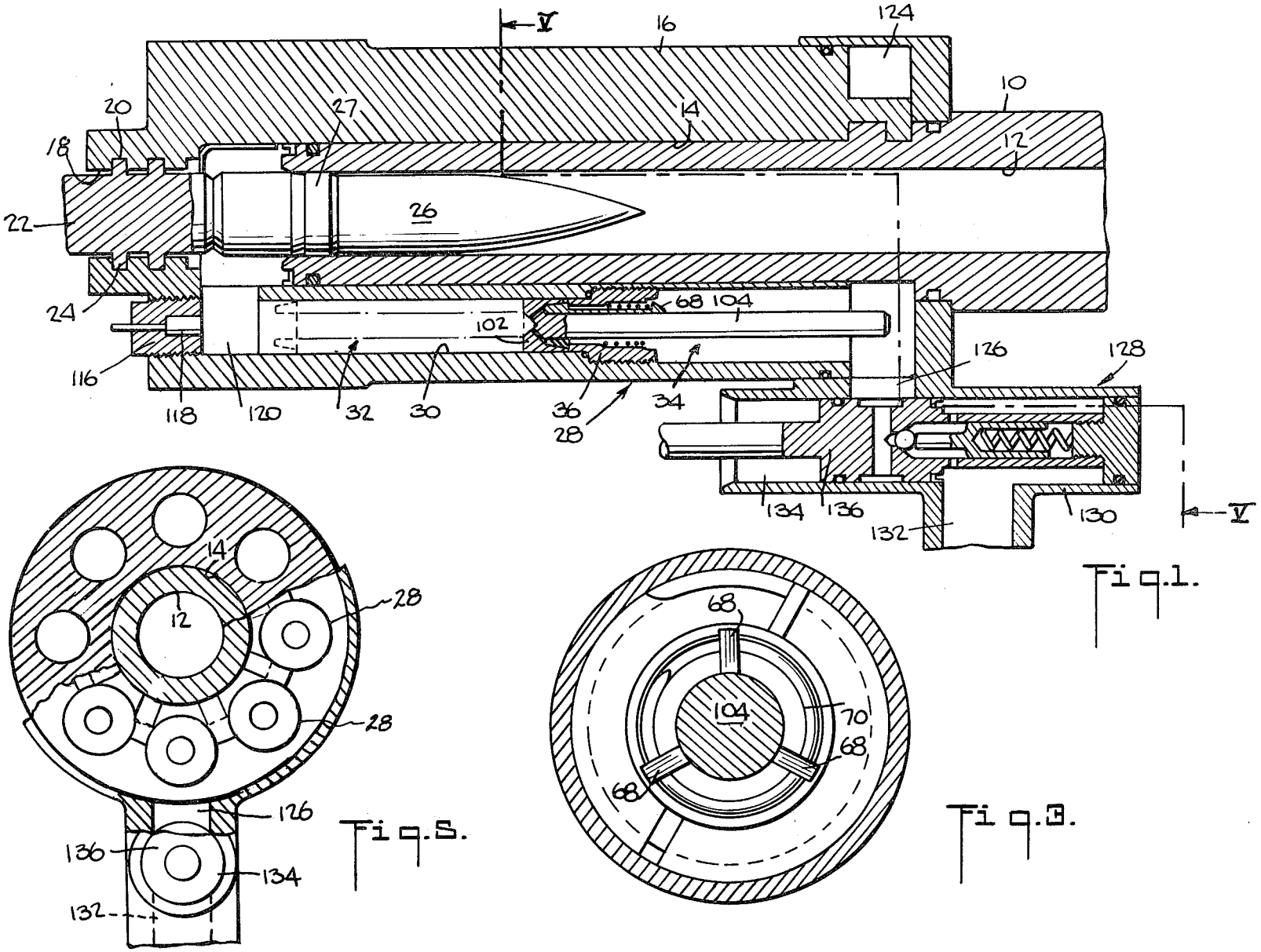
FIG. 1 is a detail view in longitudinal cross-longitudinal cross-section of a gun incorporating a combustor assembly embodying this invention.
FIG. 3 is a transverse view in cross-section taken along the plane III—III of FIG. 2.
FIG. 5 is a transverse view in cross-section of a gun incorporating a plurality of the combustor assemblies of FIG. 1 taken along the folded plan V—V.

This invention, as shown in FIG. 1, may be incorporated in a liquid propellant gun of the type shown by D. P. Tassie in U. S. Pat. No. 3,763,739. However, the invention as here shown utilizes a monopropellant, although the regenerative piston system is applicable to bipropellants as well.

The gun system includes a gun barrel 10, having a gun bore 12, which is fixed in a forward bore 14 of a housing 16. The housing has an aft bore 18, with a plurality of locking recesses 20, which receives a gun bolt 22 having a plurality of locking lugs 24. A projectile 26 having a rotating band 27 may be inserted through the aft bore 18 and pushed forwardly into the gun bore 12 by the bolt 22, which bolt is then locked in and to the housing. The bank 27 makes a gas tight seal with the bore.

Figure 2:
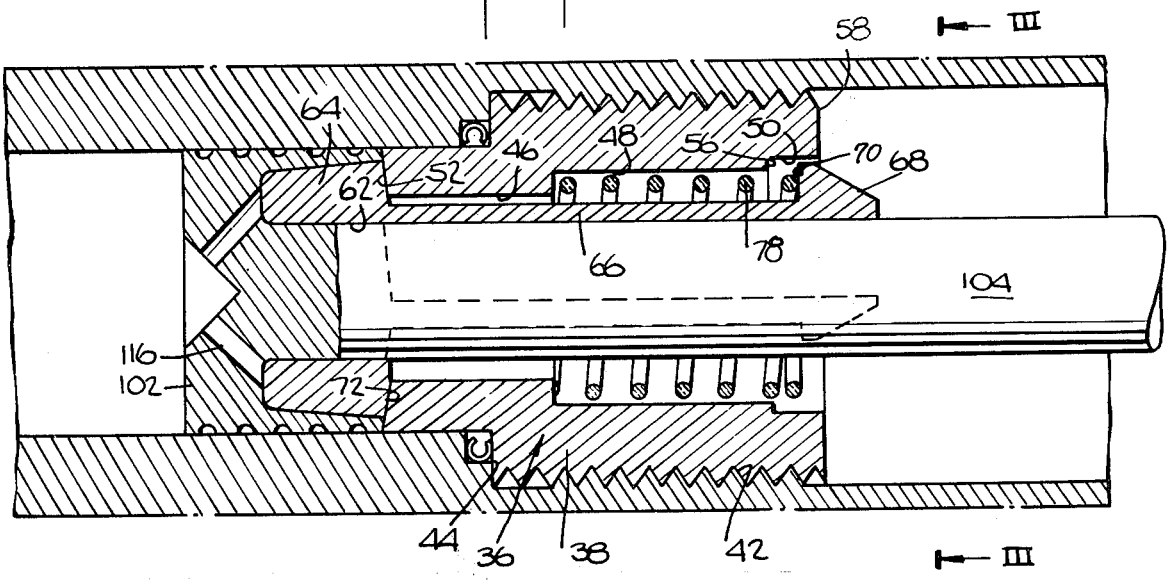
FIG. 2 is an enlarged detail of FIG. 1 of the combustor assembly in the end of propellant injection mode.
Figure 4:
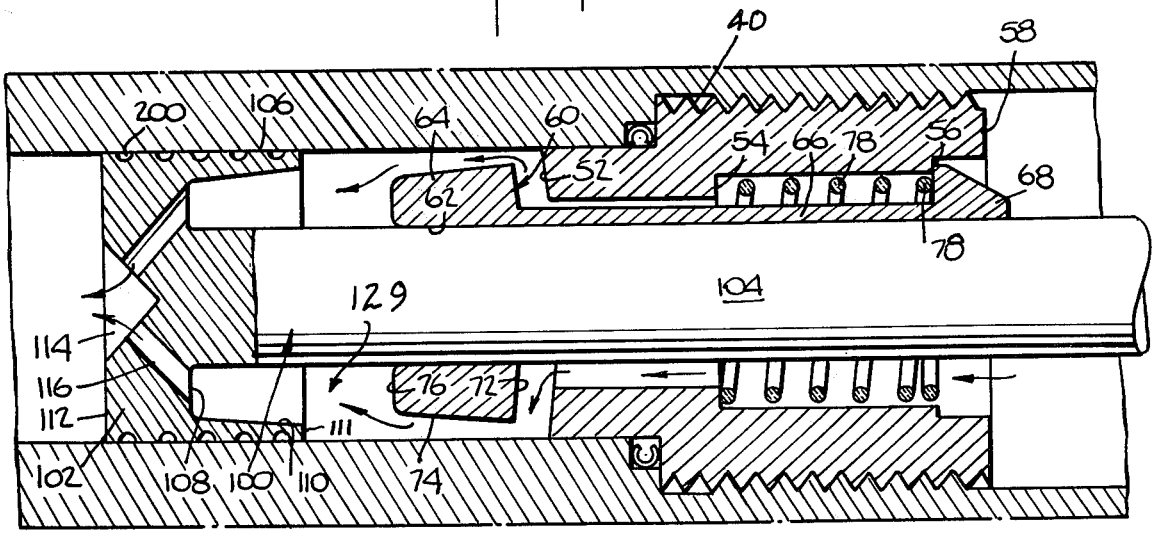
FIG. 4 is an enlarged detail of FIG. 1 of the combustor assembly in the propellant filling mode.

The housing 16 may have one, or as shown in FIG. 5, a plurality of combustor assemblies 28. As shown in FIGS. 1, 2 and 4, each combustor assembly includes a longitudinal bore 30 having a combustion chamber portion 32 and a liquid propellant inlet chamber portion 34. A coaxial check valve 36 is fixed in the bore 30 and includes an outer annular housing 38 which is externally threaded at 40 to engage threads 42 and a shoulder 44 in the bore 30, and has a longitudinal bore in three stepped portions: a portion 46 having the smallest diameter, a portion 48 having an intermediate diameter, and a portion 50 having the largest diameter. The housing 38 has a left face 52, an internal shoulder 54, an internal shoulder 56, and a right face 58. A sleeve 60 has an longitudinal bore 62, a left, truncated conical, annular head portion 64, and a tail portion including an intermediate portion provided by a plurality (here shown as three) of longitudinally extending, circumferentially spaced apart, beams 66, and a right portion provided a like plurality of heel, enlarged terminations 68 on each beam. The right portion has a left face 70 which will abut the shoulder 56, the left portion has a right face 72 which will mate with and will seal against the face 52, a conical, peripheral face 74, and a left face 76. A helical compression spring 78 is disposed between the shoulder 54 and the face 70 and biases the sleeve 60 to the right.

A piston 100 has a head portion 102 which slides in the combustion chamber portion 32 and a stem portion 104 which slides in the bore 62 of the sleeve 60. The head portion has an L-ring longitudinal cross-section with an outer-peripheral surface 106 for sliding engagement with the wall of the chamber 32, a right transverse annular surface 108 which will mate with and will seal against the face 76, a right conical annular surface 110 which will mate with and will seal against the face 74, a transverse annular surface III which will mate with and will seal against the face 52 a left face 112 having a conical recess 114, and a plurality of bores 116 disposed in an annular row and interconnecting the face 108 with the recess 114.

The left end of the combustion chamber 30 is closed by a plug 116 which carries a spark plug 118. A respective radial bore 120 communicates between the respective combustion chamber 32 and the left end of the bore 12.

The right end of each liquid propellant inlet chamber portion 34 opens into an annular or manifold passageway 124, which in turn is open, at 126, to a propellant supply valve 128. The valve includes a housing 130 having an inlet port 132, a cylinder 134, and a spool 136. The spool may be cam controlled, as shown in U.S. Pat. No. 3,763,739 for synchronization with the other gun functions.

As shown in FIG. 1, before loading, the valve 128 is closed and the piston 100 is in its righthandmost position wherein it is nested with and sealed to the check valve 36. A projectile 26 is inserted into the gun bore 12 and the bolt 22 is closed and locked. The spool 136 is shifted to the left, opening the valve 128, admitting liquid propellant under pressure into the manifold 124. Propellant under pressure passes into the chamber portion 34 and into the longitudinal recesses between the beams 68, and applies pressure against the surface 72 of the portion 64 to shift the portion, against the bias of the spring 78, away from the surface 52, to permit the flow of liquid propellant around the portion 64 and against the surface 108 and 110 of the head 102 of the piston. This pressure provided by the incoming liquid propellant pushes the piston head to the left, creating and enlarging the available volume of a propellant pumping chamber portion 129 and decreasing the available volume of the combustion chamber portion. A small quantity of the liquid propellant passes through the bores 116 into the combustion chamber portion during this shifting of piston head, and thus a quantity of air which has entered when the bolt was open, plus this quantity of liquid propellant, are compressed and trapped in the combustion chamber. The liquid propellant is atomized as it passes through the bores, and the total quantity and the size of the droplets is a function, inter alia, of the diameter of the bores, the velocity of the piston and the pressure of the liquid propellant. When the piston head has reached its maximum excursion in compression, that is, leftmost travel, the liquid pressure in the pumping chamber portion 129 equals the liquid pressure in the supply manifold 124 and the supply chamber portion 34 and the spring 78 drives the sleeve 60 to the right, thereby closing the check valve 36. This quantity of compressed air and atomized propellant in the combustion chamber portion adjacent the sparkplug is predetermined and repeatable, and serves as a primer for the combustion of the main charge of propellant disposed in the supply chamber portion. Ignition of this primer is provided by the sparkplug. Ignition of the primer generates combustion gas whose pressure drives the piston to the right to increase the volume of the combustion chamber portion and to decrease the volume of the pumping chamber portion. The difference in areas of the two faces of the piston generates a difference in pressure in the two chambers so that liquid propellant is continually forced through the bores 116 into the combustion chamber at a controlled rate. The piston head is displaced continually to the right towards the closed check valve 36. As the piston head closes onto the annulus 74 of the check valve the remainder of the liquid propellant trapped therebetween provides an energy absorbing function and absorbs the energy of the moving piston head as it impacts against the check valve annulus, without any ullage. The interface surfaces 110 and 74 should be conical, approaching a cylinder, to provide maximum travel time for trapped fluid to absorb energy and pass through the bores, yet not so cylindrical as to trap liquid and prevent such liquid from reaching and passing through the bores.

The interface between the piston stem 104 and the bore 62 may be without seals, since any leakage from the pumping chamber portion will merely pass back into the supply chamber portion. The L-ring section 106 provides an effective seal between the hot gun gas in the combustion chamber and the relatively cold liquid in the pumping chamber portion, in that there is a different in pressure on the piston head which provides for the flow of liquid propellant from the pumping chamber to the combustion chamber, which precludes any flow of gun gas from the combustion chamber to the pumping chamber.

To provide lubrication between the piston head 102 and the wall of bore 32, a plurality of shallow, helical grooves 200 may be provided in the peripheral surface of the piston head, communicating from the left face 112 to the right face, adjacent 110. Liquid propellant will be forced through these apertures at the same time as through the bores 116, and will lubricate this interface. All lubricant passing into the combustion chamber portion will be in a swirl pattern, ensuring good mixing, and will be burned, either as primer, or as part of the main charge. A fresh supply of lubricant is provided during each firing cycle, and will clean out any particles which may lodge in the grooves.

Lubrication of the interface between the piston stem and the check valve sleeve is also provided by the liquid propellant.

The leakage propellant will act as a booster as well as a primer. The piston compresses air in front of it, and then creates a two-phase mixture in front of it, which on ignition, acts as a booster charge. A small booster charge results in a much faster initial chamber pressure rise which improves ballistic efficiency.

What is claimed is:

1. A pump comprising:

a cylinder having a longitudinal bore with a longitudinal axis, an inner wall, an inlet end and an outlet end;

a check valve coaxial with said longitudinal axis and closing said cylinder bore inlet end, including:

an outer annular housing fixed to and sealed within said cylinder bore inner wall, and having a longitudinal bore coaxial with said longitudinal axis and a first, substantially transverse, cylinder bore inlet end remote face, an annular sleeve disposed within said housing bore and having an annular head portion remote from said cylinder bore inlet end, a tail portion provided by a plurality of circumferentially spaced apart beams extending longitudinally from said head portion and proximal to said cylinder bore inlet end; and having a longitudinal bore coaxial with said longitudinal axis, said sleeve head portion having a first, substantially transverse, cylinder bore inlet end remote face, and a second, substantially transverse, cylinder bore inlet end proximal face, and spring means biasing said sleeve towards said cylinder bore inlet end so that said sleeve head second face abuts and seals against said housing first face;

a piston having a head portion journaled within and sealing against said cylinder bore wall and a stem portion journaled within said sleeve bore, said piston head portion having a first, substantially transverse, check valve distal face and a second, substantially transverse, check valve proximal face, said piston head second face adapted to abut and seal against said sleeve first face.

2. A pump according to claim 1 wherein:

said housing and the distal ends of said sleeve beams have interengaging means to limit the travel of said sleeve relative to said housing against the bias of said spring.

3. A pump according to claim 1 wherein:

said piston head second face and said sleeve head portion have mating faces which will congruently interfit without voids.

4. A pump according to claim 3 wherein:

said piston head second face is substantially conical to provide a longitudinal cross-section of a L-ring seal.

said housing and the distal ends of said sleeve beams have interengaging means to limit the travel of said relative to said housing against the bias of said spring.

5. A pump according to claim 1 further including:

supply means coupled to said inlet end of said cylinder bore for providing a supply of liquid under pressure thereto, the liquid adapted to flow to said check valve, between said sleeve beam portions and against said sleeve head portion second face to displace said sleeve against the bias of said spring to create a passageway around said sleeve head portion to said piston head second face to displace said piston head from said sleeve head portion to create and fill a void between said piston head and said sleeve head.

6. A pump according to claim 5 wherein:

said piston head has a plurality of bores communicating between said first and said second piston head faces, means coupled to said cylinder bore outlet end for returning said piston head to said sleeve head portion whereon liquid trapped in said void progressively absorbs the kinetic energy of said piston head through ejection of such liquid through said plurality of bores.

7. A liquid propellant gun comprising:

a gun bore having a projectile receiving chamber;

a gun bolt for opening and closing a projectile receiving chamber behind a projectile; and a pump comprising:

a cylinder having a longitudinal bore with a longitudinal axis, an inner wall, an inlet end and an outlet end, said outlet end communicating with said projectile receiving chamber;

a check valve coaxial with said longitudinal axis and closing said cylinder bore inlet end, including:

an outer annular housing fixed to and sealed within said cylinder bore inner wall, and having a longitudinal bore coaxial with said longitudinal axis and a first, substantially transverse, cylinder bore inlet end remote face, an annular sleeve disposed within said housing bore and having an annular head portion remote from said cylinder bore inlet end, a tail portion provided by a plurality of circumferentially spaced apart beams extending longitudinally from said head portion and proximal to said cylinder bore inlet end; and having a longitudinal bore coaxial with said longitudinal axis, said sleeve head portion having a first, substantially transverse, cylinder bore inlet end remote face, and a second, substantially transverse, cylinder bore inlet end proximal face, and spring means biasing said sleeve towards said cylinder bore inlet end so that said sleeve head second face abuts and seals against said housing first face;

a piston having a head portion journaled within said sealing against said cylinder bore wall and a stem portion journaled within said sleeve bore, said piston head portion having a first, substantially transverse, check valve distal face and a second, substantially transverse, check valve proximal face, said piston head second face adapted to abut and seal against said sleeve first face.

8. A gun according to claim 7 wherein:

said piston head second face and said sleeve head portion have mating faces which will congruently interfit without voids.

9. A gun according to claim 7 wherein:

said housing and the distal ends of said sleeve beams have interengaging means to limit the travel of said sleeve relative to said housing against the bias of said spring.

10. A gun according to claim 7 further including:

supply means coupled to said inlet end of said cylinder bore for providing a supply of liquid under pressure thereto, the liquid adapted to flow to said check alve, between said sleeve beam portions and against said sleeve head portion second face to displace said sleeve against the bias of said spring to create a passageway around said sleeve head portion to said piston head second face to displace said piston head from said sleeve head portion to create and fill a void between said piston head and said sleeve head.

11. A gun according to claim 10 wherein:

said piston head has a plurality of bores communicating between said first and said second piston head faces, means coupled to said cylinder bore outlet end for returning said piston head to said sleeve head portion whereon liquid trapped in said void progressively absorbs the kinetic energy of said piston head through ejection of such liquid through said plurality of bores.

* * * * *

UNITED STATES PATENT OFFICE

CERTIFICATE OF CORRECTION

PATENT NO. : 4,023,463

DATED : May 17, 1977

INVENTOR(S) : Douglas Pray Tassie

It is certified that error appears in the above-identified patent and that said Letters Patent are hereby corrected as shown below:

Column 1, line 10 change "afte" to --after--; line 34 change "different" to --differential--; line 46, after "combustion" insert --chamber--, change "abd" to --and--; line 56, change "different" to --differential--.
Column 2, line 68 change "III" to --111--.
Column 3, line 11 delete "or manifold"; line 12, after "way" insert --or manifold--; line 31, change "surface" to --surfaces-- line 40 change "has" to --had--.
Claim 4, delete lines 29, 30, 31, and 32.
Claim 7, line 24, change "said" to --and--.
Claim 10, line 46, change "alve" to --valve--.

Signed and Sealed this thirtieth Day of August 1977

[SEAL]

*Attest:*

RUTH C. MASON
*Attesting Officer*

C. MARSHALL DANN
*Commissioner of Patents and Trademar*